US010196864B2

(12) United States Patent
Deere et al.

(10) Patent No.: US 10,196,864 B2
(45) Date of Patent: Feb. 5, 2019

(54) SNUBBER FOR DOWNHOLE TOOL

(71) Applicant: TOLTEQ GROUP, LLC, Cedar Park, TX (US)

(72) Inventors: Paul R. Deere, Cedar Park, TX (US); David Chandos, Salado, TX (US); Graham Motzing, Austin, TX (US); Jacob Thomas, Leander, TX (US); Patrick Mendez, Cedar Park, TX (US)

(73) Assignee: TOLTEQ GROUP, LLC, Cedar Park, TX (US)

( * ) Notice: Subject to any disclaimer, the term of this patent is extended or adjusted under 35 U.S.C. 154(b) by 125 days.

(21) Appl. No.: 15/306,007

(22) PCT Filed: Apr. 29, 2015

(86) PCT No.: PCT/US2015/028186
§ 371 (c)(1),
(2) Date: Oct. 21, 2016

(87) PCT Pub. No.: WO2015/168226
PCT Pub. Date: Nov. 5, 2015

(65) Prior Publication Data

US 2017/0044845 A1 Feb. 16, 2017

Related U.S. Application Data

(60) Provisional application No. 61/986,871, filed on Apr. 30, 2014.

(51) Int. Cl.

| | |
|---|---|
| ***E21B 17/07*** | (2006.01) |
| ***E21B 47/01*** | (2012.01) |
| *E21B 17/10* | (2006.01) |

(52) U.S. Cl.
CPC ..... *E21B 17/07* (2013.01); *E21B 47/011* (2013.01); *E21B 17/1078* (2013.01)

(58) Field of Classification Search
CPC ..... E21B 17/07
See application file for complete search history.

(56) References Cited

U.S. PATENT DOCUMENTS 2,212,153 A 8/1940 Eaton et al.
2,296,198 A * 9/1942 Boynton ..... E21B 17/046 285/111

(Continued)

FOREIGN PATENT DOCUMENTS

CN 2594445 Y 12/2003
CN 201110137 Y 9/2008

(Continued)

OTHER PUBLICATIONS

European Extended Search Report dated Nov. 27, 2017, for European Application No. 15786853.0 (8 p.).

(Continued)

*Primary Examiner* — D. Andrews
(74) *Attorney, Agent, or Firm* — Conley Rose, P.C.

(57) ABSTRACT

An apparatus for protecting sensitive electronics in a downhole tool from mechanical shock and vibration. The apparatus includes a frustum-shaped sleeve configured to be disposed between the downhole tool and another downhole component through which a mechanical shock may travel to the downhole tool. The mechanical shocks may result in axial, radial, and/or rotations stress on the downhole tool. The frustum-shaped sleeve is disposed on one part of an interconnection pair made of a mating plug and a mating receptacle.

26 Claims, 14 Drawing Sheets

(56) References Cited

U.S. PATENT DOCUMENTS

| | | | | |
|---|---|---|---|---|
| 2,587,105 | A | 2/1952 | Blasito | |
| 2,795,398 | A | 6/1957 | Ragland | |
| 3,254,508 | A * | 6/1966 | Garrett | E21B 17/07 175/321 |
| 4,600,062 | A | 7/1986 | Teng | |
| 4,754,820 | A | 7/1988 | Watts et al. | |
| 5,934,378 | A | 8/1999 | Tchakarov | |
| 7,011,344 | B1 | 3/2006 | Bakke | |
| 2006/0118297 | A1 * | 6/2006 | Finci | E21B 17/07 166/242.1 |
| 2008/0066965 | A1 | 3/2008 | Pabon et al. | |
| 2013/0000983 | A1 | 1/2013 | Hansen | |

FOREIGN PATENT DOCUMENTS

| | | | |
|---|---|---|---|
| CN | 201318164 | Y | 9/2009 |
| EP | 0488875 | A2 | 6/1992 |
| RU | 2149253 | C1 | 5/2000 |
| UA | 1487 | A | 7/1994 |

OTHER PUBLICATIONS

International Application No. PCT/US2015/028186 International Search Report and Written Opinion dated Jul. 22, 2015 (10 pages).
Chinese Office Action dated Mar. 29, 2018, for Chinese Application No. 201580021709.2 (9 p.).
English Translation of Chinese Office Action dated Mar. 29, 2018, for Chinese Application No. 201580021709.2 (10 p.).
Russian Office Action dated Aug. 13, 2018, for Russian Application No. 2016143160 (6 p.).
English Translation of Russian Office Action dated Aug. 13, 2018, for Russian Application No. 2016143160 (7 p.).
European Examination Report dated Sep. 25, 2018, for European Application No. 15786853.0 (4 p.).

* cited by examiner

SNUBBER FOR DOWNHOLE TOOL

CROSS REFERENCE TO RELATED APPLICATIONS

This application is a 35 U.S.C. § 371 national stage entry of PCT/US2015/028186, filed Apr. 29, 2015, and entitled "Snubber for Downhole Tool," which claims the benefit of Provisional U.S. Patent Application No. 61/986,871, filed Apr. 30, 2014, and entitled "Snubber for Downhole Tool," both of which are incorporated herein by reference in their entireties for all purposes.

BACKGROUND OF THE DISCLOSURE

1. Field of the Disclosure

This disclosure relates to the field of downhole tools associated with rotary drilling in earth formations, especially to reduction of damage and wear due to mechanical shock and vibration.

2. Description of the Related Art

Rotary drilling in earth formations is used to form boreholes for obtaining materials in the formations, such as hydrocarbons. Rotary drilling involves a drill bit disposed on a drilling end of a drill string that extends from the surface. The drill string is made up of a series of tubulars that are configured to allow fluid to flow between the surface and earth formation. Above and proximate to the drill bit may be formation and/or borehole measurement tools for measurement-while-drilling. Multiple tools may be grouped together as a bottom hole assembly.

During rotation of the drill bit, downhole tools in the bottom hole assembly may be subjected to vibrations and mechanical shocks that can damage the measurement tools, communication along the drill string, or connections between downhole tools and other downhole components. The electronic and mechanical devices in tools may be particularly sensitive to mechanical shock and vibration. Damage to electronics in downhole tools may reduce reliability and life of the tool. Failure of the tool can result in costly downtime due to halted drilling operations and tool repairs before drilling may resume. To reduce damage, and thus failures due to mechanical shock and vibration, the tools may be isolated from mechanical shocks by one or more shock absorbing devices, commonly called snubbers.

A snubber is generally a component configured to reduce tool damage and wear due to stresses caused by mechanical shock and vibration. Conventional snubbers reduce the mechanical shocks being transmitted along the longitudinal axis of a drill string from the direction of the drill bit through compressibility of the snubber material. The conventional snubber may be spring or elastomeric ring configured to compress longitudinally when exposed to mechanical shocks. The shock absorbing ability of the snubber is often a function the thickness and type of snubbing material. As such, snubbers are typically disposed on the side of a downhole tool where mechanical shocks are most likely to be generated.

There is a need for a durable snubber that reduces mechanical shocks to downhole tools. There is a need for a snubber that provides protection against shocks in radial and/or rotational directions as well as the longitudinal direction. There is also a need for a snubber that provides different degrees of protection along different degrees of freedom of the downhole tool.

BRIEF SUMMARY OF THE DISCLOSURE

In aspects, the present disclosure is related downhole tools associated with rotary drilling in earth formations.

Specifically, the present disclosure is related to reducing damage and wear due to mechanical shock and vibration.

One embodiment includes an apparatus for reducing mechanical shock and vibration in a downhole tool configured to be disposed in a borehole, the apparatus comprising: a frustum-shaped sleeve configured to be disposed between a downhole tool and another downhole component, wherein the downhole tool and the downhole component are configured to mate with each other, and wherein the frustum-shaped sleeve comprises a mechanical shock absorbing material. One of the downhole component and the downhole tool may have a frustum-shaped mating plug with an outer surface configured to receive the frustum-shaped sleeve, and the other of the downhole component and the downhole tool may have a receptacle configured to receive the mating plug. The surface may be substantially smooth or radially corrugated. The downhole component may include one of: another downhole tool and a centralizer.

The mechanical shock absorbing material may include an elastomeric material. The elastomeric material may have a durometer value between about 10A and about 60A. In some aspects, the elastomeric material has a durometer value of between about 20A and about 40A. In some aspects, the elastomeric material has a deformation point above 260 degrees C. In some aspects, the elastomeric material retains its duro meter value over a temperature range of about −50 degrees C. to about 175 degrees C. The elastomeric material may include silicone.

The mechanical shock absorbing material may include a corrugated metal. The metal may be corrugated radially or longitudinally relative to an axis of the frustum-shaped sleeve. The frustum-shaped mating plug may be made of the same metal as the corrugated metal. The mechanical shock absorbing material is selected to retain its temper in a temperature range of about −50 degrees C. to about 175 degrees C.

The frustum-shaped sleeve may be a conical or pyramidal in shape. The frustum-shaped sleeve may have an interior angle in a range of about 5 degrees to about 80 degrees. In some aspects, the frustum-shaped sleeve may have an interior angle in a range of about 5 degrees to about 35 degrees. In some aspects, the frustum-shaped sleeve may have an interior angle in a range of about 8 degrees to about 28 degrees.

Another embodiment according to the present disclosure is an apparatus for operating in a borehole, the apparatus comprising: a downhole tool configured to perform an electronic operation; a downhole component configured to interconnect with the downhole tool; and a frustum-shaped sleeve disposed between the downhole tool and the downhole component at the interconnection and comprising a mechanical shock absorbing material. One of the downhole tool and the downhole component may have a frustum-shaped mating plug with an outer surface configured to receive the frustum-shaped sleeve and the other may have a mating receptacle configured to receive the mating plug. The outer surface of the mating plug may be radially corrugated or substantially smooth. The inner surface of the mating receptacle may be radially corrugated or substantially smooth. The downhole component may include one of: another downhole tool and a centralizer.

The mechanical shock absorbing material may comprise an elastomeric material or a corrugated metal. The elastomeric material may have a durometer value between about 10A and about 60A. In some aspects, the elastomeric material has a durometer value of between about 20A and about 40A. In some aspects, the elastomeric material has a deformation point above 260 degrees C. In some aspects, the elastomeric material retains is durometer value over a temperature range of about −50 degrees C. to about 175 degrees C. The elastomeric material may include silicone.

The mechanical shock absorbing material may include a corrugated metal. The metal may be corrugated radially or longitudinally relative to an axis of the frustum-shaped sleeve. The frustum-shaped mating plug may be made of the same metal as the corrugated metal. The mechanical shock absorbing material is selected to retain its temper in a temperature range of about −50 degrees C. to about 175 degrees C.

The frustum-shaped sleeve may be a conical or pyramidal in shape. The frustum-shaped sleeve may have an interior angle in a range of about 5 degrees to about 80 degrees. In some aspects, the frustum-shaped sleeve may have an interior angle in a range of about 5 degrees to about 35 degrees. In some aspects, the frustum-shaped sleeve may have an interior angle in a range of about 8 degrees to about 28 degrees.

The frustum-shaped mating plug may be hollow and have a first opening and a second opening further comprising: a preload retainer configured to be partially inserted into the smaller of the two openings of the frustum-shaped mating plug, the preload retainer comprising: a boss dimensioned to be larger than an inner diameter of the smaller opening, and a tube with an outer diameter that is smaller than the inner diameter of the smaller opening. The frustum-shaped mating plug and the mating receptacle may be configured to slidingly engage to form the interconnection.

Examples of the more important features of the disclosure have been summarized rather broadly in order that the detailed description thereof that follows may be better understood and in order that the contributions they represent to the art may be appreciated. There are, of course, additional features of the disclosure that will be described hereinafter and which will form the subject of the claims appended hereto.

BRIEF DESCRIPTION OF THE DRAWINGS

A better understanding of the present disclosure can be obtained with the following detailed descriptions of the various disclosed embodiments in the drawings, which are given by way of illustration only, and thus are not limiting the present disclosure, and wherein.

DETAILED DESCRIPTION OF THE DISCLOSURE

Figure 1:
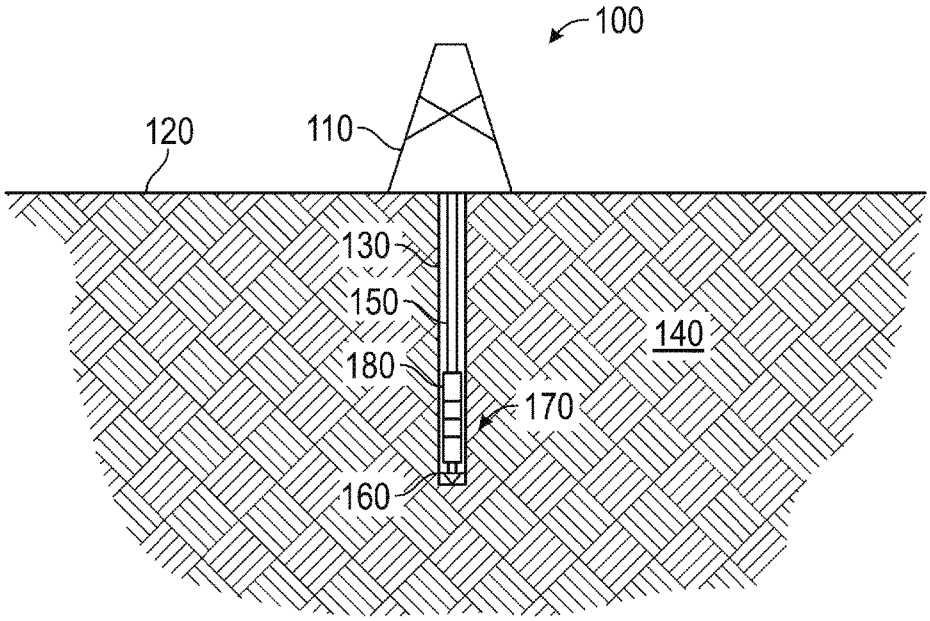
FIG. 1 is a diagram of a drilling system with a bottom hole assembly configured for use in a borehole that includes downhole tools according to one embodiment of the present disclosure.

In aspects, the present disclosure is related to downhole drilling operations. Specifically, the present disclosure is related to protection of components of downhole tools that may be sensitive to the mechanical shock and vibration that occurs during drilling operations and may reduce the operating lifetime of the downhole tools. The present invention is susceptible to embodiments of different forms. There are shown in the drawings, and herein will be described in detail, specific embodiments with the understanding that the present invention is to be considered an exemplification of the principles and is not intended to limit the present invention to that illustrated and described herein.

FIG. 1 shows a diagram of a drilling system 100 that includes a drilling rig 110 disposed on a surface 120 and above a borehole 130 in an earth formation 140. Disposed in the borehole 130 is drill string 150 with a drill bit 160 at the bottom of the borehole 130. Above the drill bit 160 is a bottom hole assembly 170 that includes one or more downhole tools 180. The downhole tools 180 may be configured for measurement, communication, and other operations during drilling.

Figure 2A:
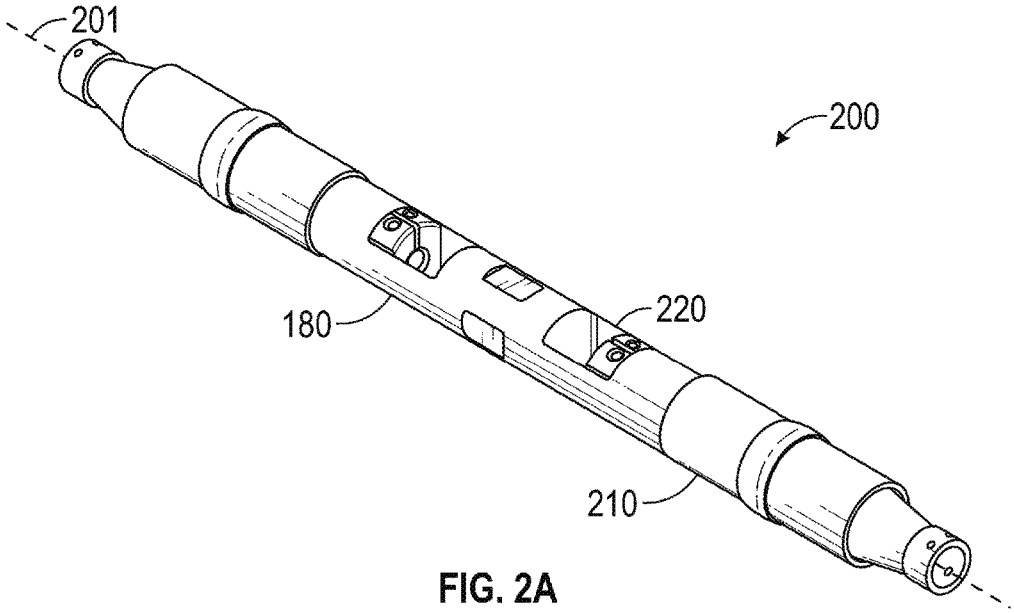
FIG. 2A is a 3-D view of a downhole tool mated with a downhole component according to one embodiment of the present disclosure.
Figure 2B:
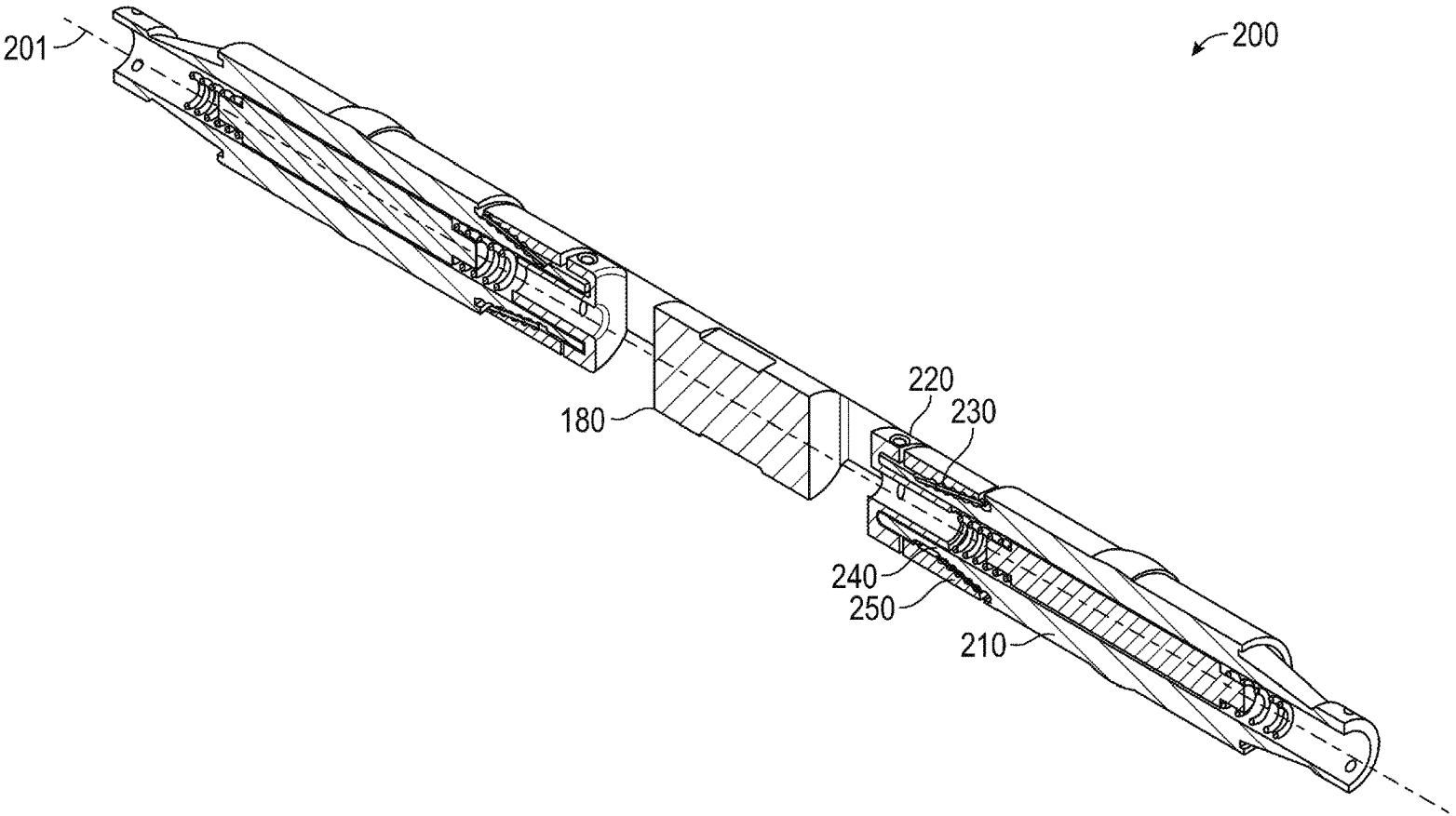
FIG. 2B is a 3-D cross-sectional view along the length of the tool of FIG. 2A.

FIGS. 2A and 2B show diagrams of one of the downhole tools 180 connected to another downhole component 210 to form a set 200 of interconnected components that includes a snubber 230 between the downhole component 210 and the downhole tool 180. FIG. 2A shows set 200 has an axis 201 which is shared with the downhole component 210 and the downhole tool 180. The downhole component 210 may be another downhole tool, a centralizer, or an interconnection sub. A preload retainer 220 is disposed on the downhole tool 180 to apply pressure to a spring in the downhole component 210. The preload retainer 220 is optional in some embodiments.

The downhole tool 180 and the downhole component 210 mate to form an interconnection. The snubber 230 is shown disposed between a mating plug 240 and a mating receptacle 250. While FIG. 2B shows a cross-section of the set 200 so that the mating plug 240 on the downhole component 210 and the mating receptacle 250 on the downhole tool 180 may be viewed. The mating connection in FIG. 2B is illustrative and exemplary only, and, in some embodiments, the mating plug 240 may be disposed on the downhole tool 180 and the mating receptacle 250 may be disposed on the downhole component 210.

Figure 2C:
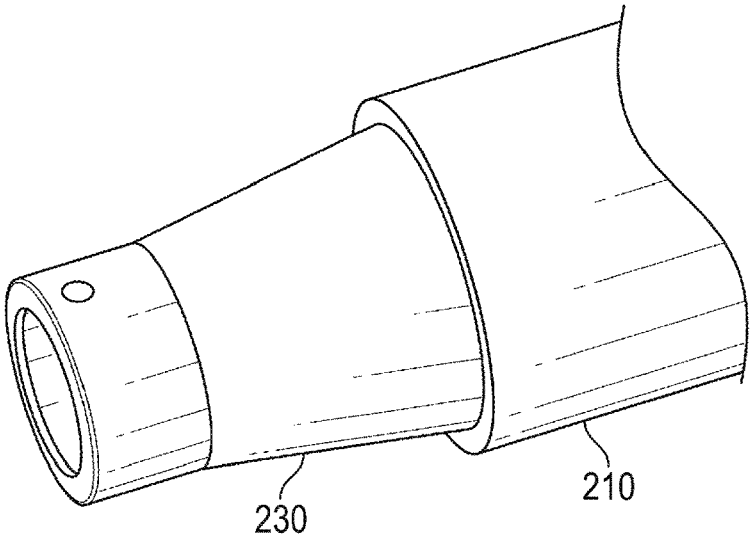
FIG. 2C is a 3-D view of a snubber on a mating plug according to one embodiment of the present disclosure.

FIG. 2C shows a diagram of the snubber 230 disposed on the downhole component 210. The snubber 230 comprises a material that absorbs mechanical shocks and vibrations. The snubber 230 is substantially frustum-shaped sleeve, meaning that it has the shape of a cone or pyramid that is hollowed out and truncated by a plane that is substantially parallel with a plane forming the base of the cone or pyramid. The thickness of the sleeve may be varied based on the desired mechanical shock dampening and design requirements of the downhole tool 180. The snubber 230 is configured to be received by another frustum-shaped component, such as frustum-shaped portion of the downhole component 210 or of the downhole tool 180.

The snubber 230 is configured to operate in a borehole environment including an environment where hydrocarbon drilling and production occur. The snubber 230 is made of a material suitable for downhole operating conditions as would be understood by a person of ordinary skill in the art.

The snubber 230 may be an elastomeric material. The elastomeric material may have a Shore durometer value of between about 10A and 60A. In some embodiments, the elastomeric material may have a Shore durometer value of between about 20A and 40A. The elastomeric material may retain a Shore durometer value in its designed range over a range of temperatures between about −50 degrees C. and about 175 degrees C. In some embodiments, the elastomeric material is silicone.

Figure 2D:
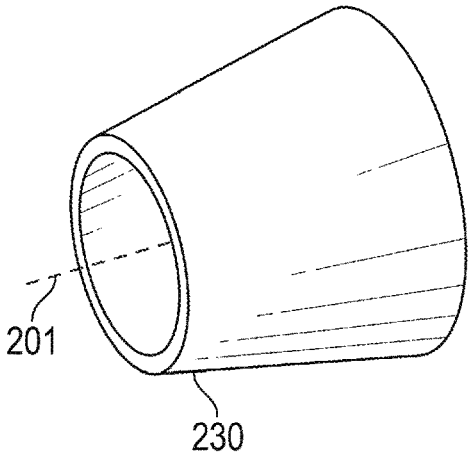
FIG. 2D is a 3-D view of an elastomeric snubber as a hollow conical frustum according to one embodiment of the present disclosure.

FIG. 2D shows a diagram of the snubber 230 as a conical frustum with a smooth surface. The snubber 230 may also be formed as a pyramidal frustum. As with any frustum, the snubber 230 will have in interior angle which is defined as the angle from the apex (if the frustum were a complete cone or pyramid) to the snubber 230 may have in interior angle in a range of about 5 degrees to 80 degrees. In some embodiments, the snubber may have in interior angle of about 5 degrees to about 35 degrees. Further, in some embodiments, the snubber may have an interior angle of about 8 degrees to about 28 degrees.

Figure 3A:
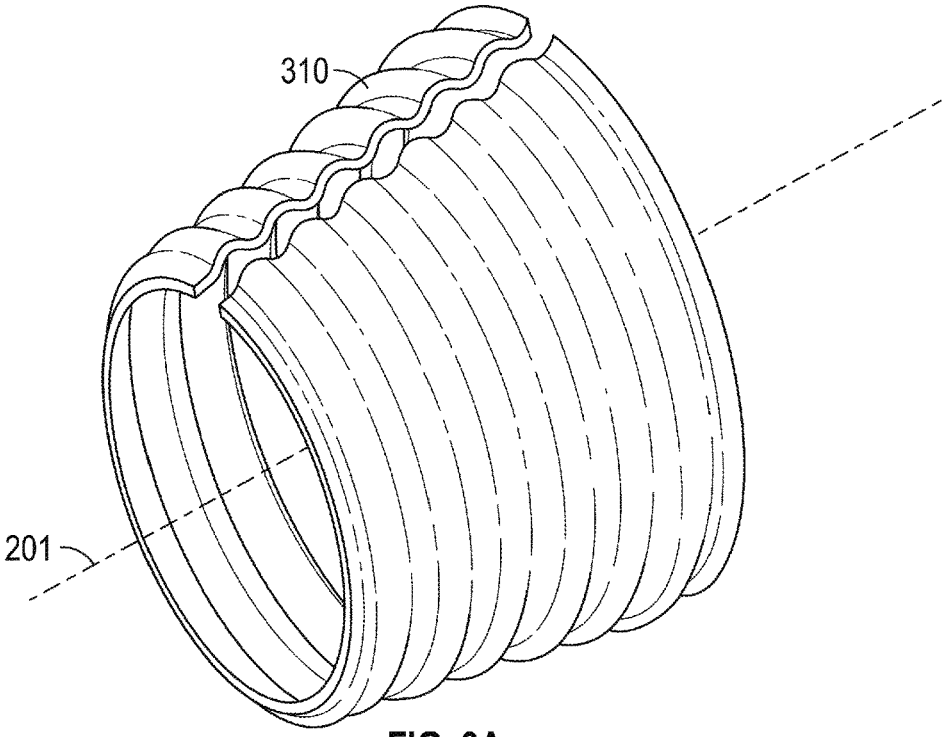
FIG. 3A is a 3-D view of a metallic snubber as a hollow conical frustum with radial corrugations according to one embodiment of the present disclosure.
Figure 3B:
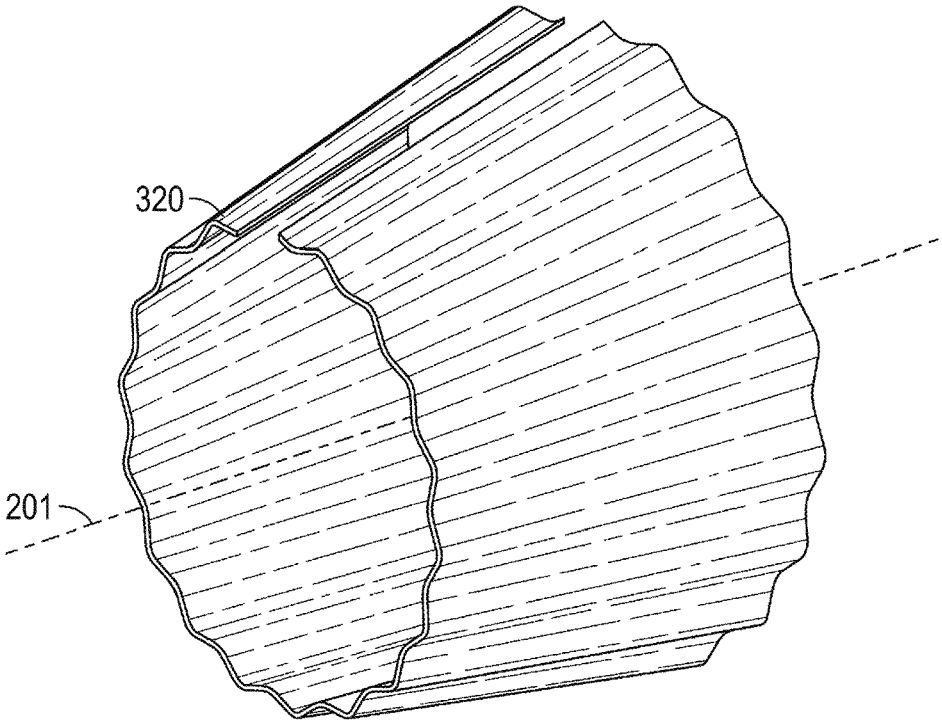
FIG. 3B is a 3-D view of a metallic snubber as a hollow conical frustum with longitudinal corrugations according to one embodiment of the present disclosure.

FIGS. 3A and 3D shows diagrams of the snubber 310, 320 comprising a metal. The metal snubbers 310, 320 may have many of the properties of the snubber 230, including its frustum shape, interior angles, and mechanical shock absorbing properties. The metal snubber 310, 320 may be corrugated. Herein, corrugated is used to describe any surface that has two or more uniform, alternating ridges or grooves, whether sharp (such as saw-toothed) or smooth (such as ripple). The metal snubber 310, 320 is configured to be received by a substantially smooth surface of the frustum-shaped portion of either the downhole tool 180 or the downhole component 210. The metal may be selected so the corrugated form remains suitable (retains its temper, etc.) for mechanical shock absorption over a temperature range of about −50 degrees C. to about 175 degrees C. In FIG. 3A, the snubber 310 is shown with radial corrugations in relation to axis 201. In FIG. 3B, the snubber 320 is shown with longitudinal corrugations in relation to axis 201. The metal snubbers 310, 320 may have the same frustum shape the elastomeric snubber 230, though the metal snubbers 310, 320 have corrugated surfaces.

Figure 3C:
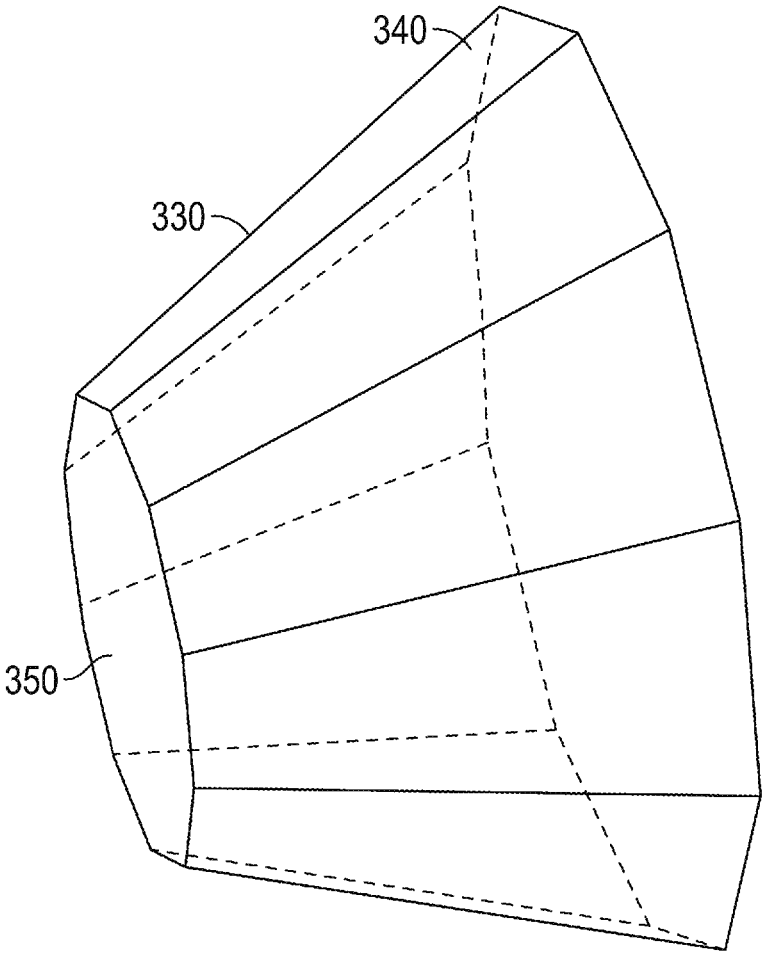
FIG. 3C is a 3-D view of a snubber as a hollow pyramidal frustum according to one embodiment of the present disclosure.

FIG. 3C shows a diagram of a snubber 330 having a hollow pyramidal frustum shape. The snubber 330 may be metal or elastomeric. While shown with 10 sides, this is not a limitation and the snubber 330 may have 4 or more sides. The snubber 330 may be configured to be received by a pyramidal frustum-shaped mating plug 240 with an identical number of sides as the snubber 330. In this way, the pyramidal frustum shape of the snubber 330 may provide its own internal clocking to the pyramidal frustum shape of either a mating plug 240 or a mating receptacle 250. In some embodiments, the sides will be uniform. In some embodiments, the snubber 330 may have 4 to 20 sides. As shown, the snubber 330 has a pyramidal frustum-shape on the outside 340 and the inside 350 with a substantially uniform thickness; however, this illustrative and exemplary only. In some embodiments, one of the outside 340 and the inside 350 may be pyramidal frustum-shaped while the other is conical frustum-shaped. Thus, a mating plug 240 with an exterior that is one of a conical and pyramidal frustum-shape and a mating receptacle 250 with an interior that is the other of the conical and pyramidal frustum-shape may be used together when the snubber 330 is configured with to be received by both.

Figure 4A:
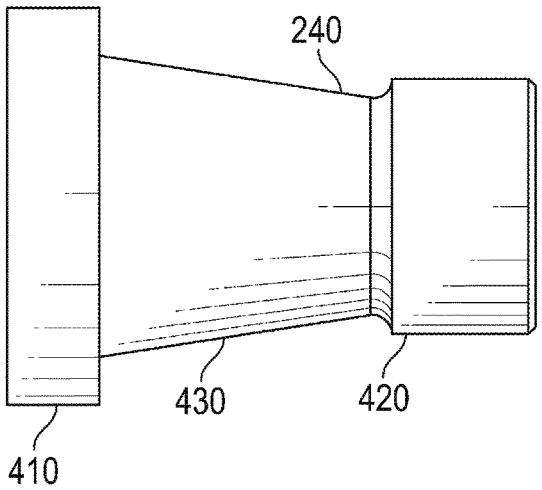
FIG. 4A is a 3-D view of the mating plug of FIG. 2C without the snubber.

FIG. 4A shows a diagram of a mating plug 240 configured to receive the snubber 230. The mating plug 240 may include a section 410 with a larger outer diameter than the largest inner diameter of the snubber 230 to prevent longitudinal movement of the snubber 230 toward the component 210 or tool 180 with the mating plug 240. The mating plug 240 may also include a boss 420 with an outer diameter larger than the smaller inner diameter of the snubber 230 to prevent longitudinal movement of the snubber 230 away from the component 210 or tool 180. The mating plug 240 may have a smooth frustum-shaped section 430 configured to receive the elastomeric snubber 230 between the section 410 and the boss 420.

Figure 4B:
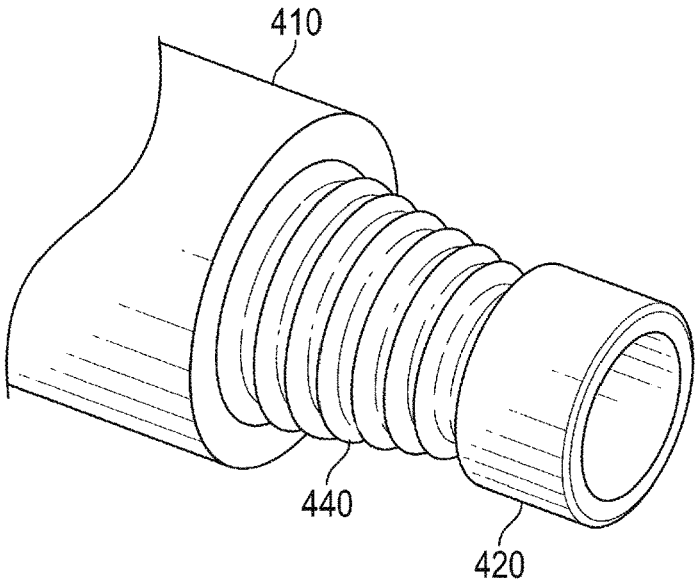
FIG. 4B is a 3-D view of a mating plug with radial corrugations according to one embodiment of the present disclosure.

FIG. 4B shows a diagram of a mating plug 240 with a corrugated frustum-shaped section 440 configured to receive an elastomeric snubber 230. The section 440 is disposed between the section 410 and the boss 420.

Figure 5A:
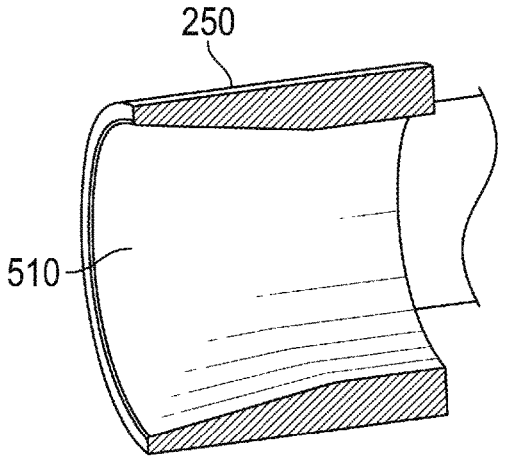
FIG. 5A is a 3-D cross-sectional view of the mating receptacle from FIG. 2B.

FIG. 5A shows a diagram of the mating receptacle 250 from FIG. 2B. The mating receptacle 250 may have a substantially smooth inner surface 510. The substantially smooth inner surface 510 is suitable for receiving a mating plug 240 with a snubber 230, 310, 320 on the surface of the mating plug 240.

Figure 5B:
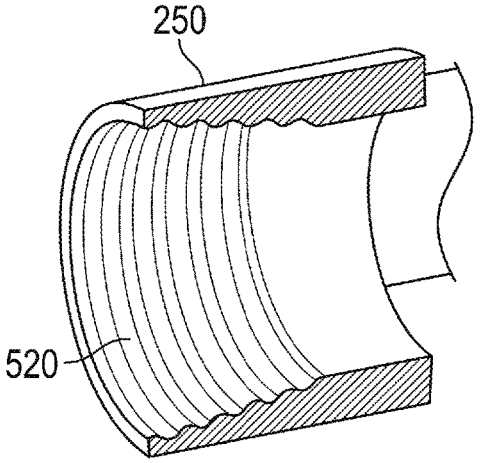
FIG. 5B is a 3-D cross-sectional view of a mating receptacle with radial corrugations according to one embodiment of the present disclosure.

FIG. 5B shows a diagram of a mating receptacle 250 with a corrugated surface 520. The corrugated surface 520 is suitable for receiving a mating plug 240 with a snubber 230 on the surface of the mating plug 240. The corrugated surface 520 is shown in a radial corrugation pattern; however, it is also contemplated that the mating receptacle 250 may have longitudinal corrugations.

Figure 6A:
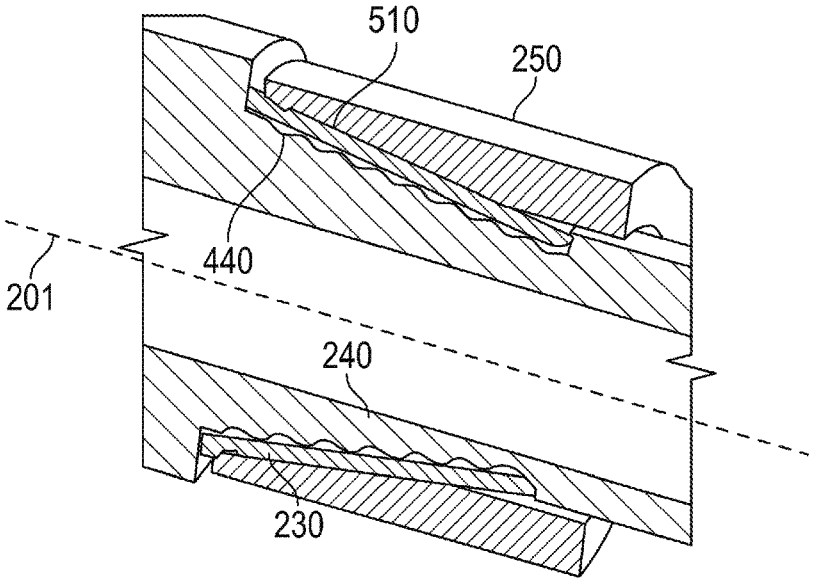
FIG. 6A is 3-D a cross-sectional view along the length of an elastomeric snubber disposed between a corrugated mating plug and a substantially smooth mating receptacle according to one embodiment of the present disclosure.

FIG. 6A shows a cross-section diagram of the snubber 230 in one embodiment of a connection between the mating plug 240 and the mating receptacle 250. The snubber 230 is disposed between the corrugated surface 440 of the mating plug 240 and the substantially smooth surface 510 of the mating receptacle 250.

When mechanical shocks are received along the longitudinal axis 201, the force of the shock may be partially or fully absorbed by the snubber 230. The frustum-shape provides a larger surface area for absorption of the shock than a conventional ring snubber while still dimensioned to fit within the interior dimension of the mating receptacle 250. By distributing the shock over a larger surface area, the snubber 230 provides more shock absorption than a ring-shaped snubber of the same material, thickness, and radius relative to longitudinal axis 201. Thus, the frustum-shaped snubber 230 may provide similar shock dampening while thinner, or, at the same thickness of a conventional ring-shaped snubber, provide greater shock dampening and increased life expectancy. The frustum-shape also provides radial damping when lateral shocks are received and rotational damping when rotational shocks are received.

Figure 6B:
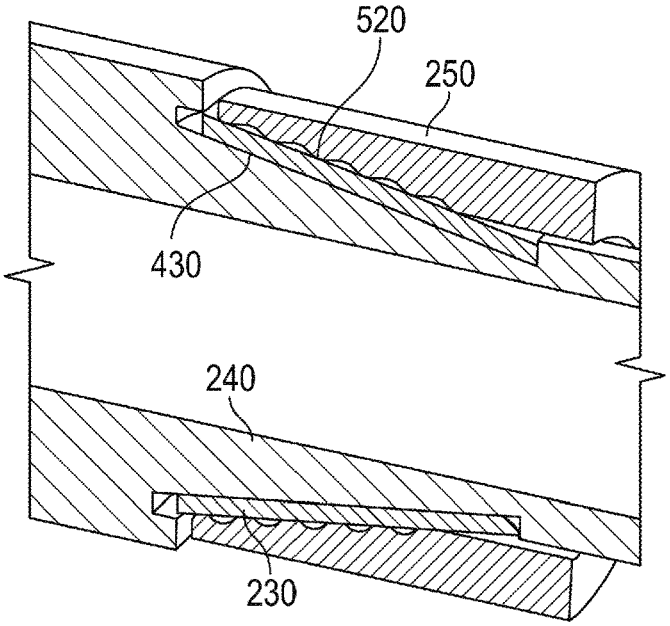
FIG. 6B is a 3-D cross-sectional view along the length of an elastomeric snubber of FIG. 2D disposed between a substantially smooth mating plug and a corrugated mating receptacle according to one embodiment of the present disclosure.

FIG. 6B shows a cross-section diagram of the snubber 230 in another embodiment of a connection between the mating plug 240 and the mating receptacle 250. Here, the snubber 230 is disposed between the substantially smooth surface 430 of the mating plug 240 and the corrugated surface 520 of the mating receptacle 250.

Figure 6C:
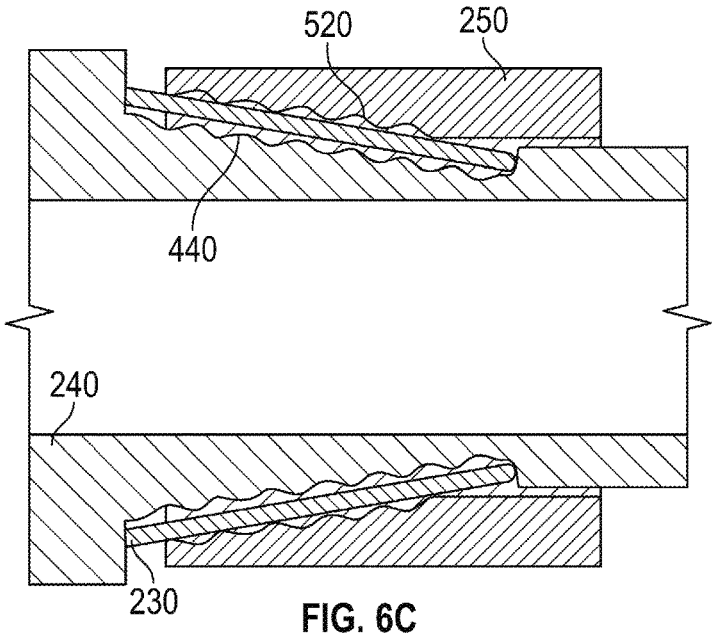
FIG. 6C is a 2-D cross-sectional view along the length of an elastomeric snubber disposed between a corrugated mating plug and a corrugated mating receptacle with interlocking corrugations according to one embodiment of the present disclosure.

FIG. 6C shows a cross-section diagram of the snubber in another embodiment of the connection between the mating plug 240 and the mating receptacle 250. Here, the snubber 230 is disposed between the corrugated surface 440 of the mating plug 240 and the corrugated surface 520 of the mating receptacle 250. The corrugations of the corrugated surface 440 and the corrugated surface 520 are aligned so that the peaks and valleys of one corrugated surface are aligned with the valleys and peaks of the other corrugated surface so as to "interlock" with one another.

Figure 6D:
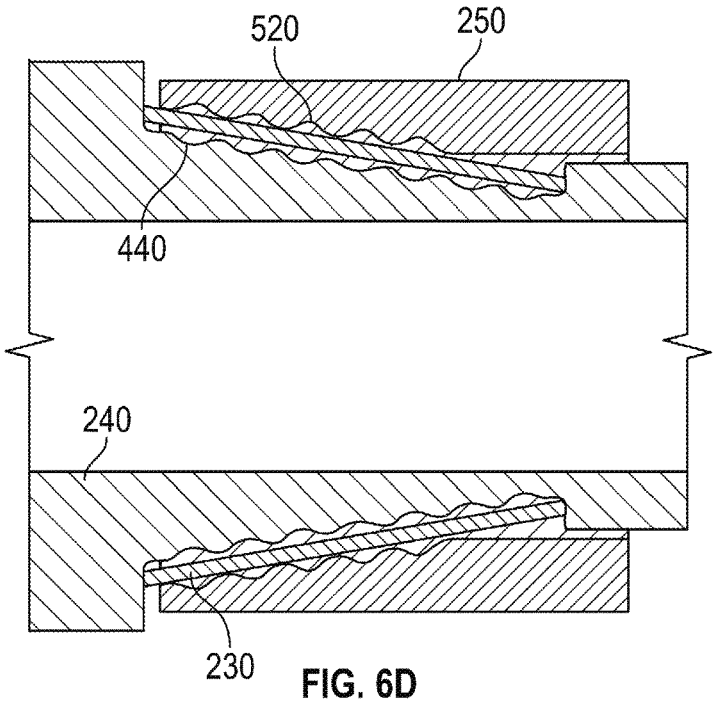
FIG. 6D is a 2-D cross-sectional view along the length of an elastomeric snubber disposed between a corrugated mating plug and a corrugated mating receptacle with opposing corrugations according to one embodiment of the present disclosure.

FIG. 6D shows a cross-section diagram of the snubber in another embodiment of the connection between the mating plug 240 and the mating receptacle 250. Here, the snubber 230 is disposed between the corrugated surface 440 of the mating plug 240 and the corrugated surface 520 of the mating receptacle 250. The corrugations of the corrugated surface 440 and the corrugated surface 520 are aligned so that the peaks and valleys of one corrugated surface are aligned with the peaks and valleys of the other corrugated surface so as to match or be "opposed" to one another.

Figure 7:
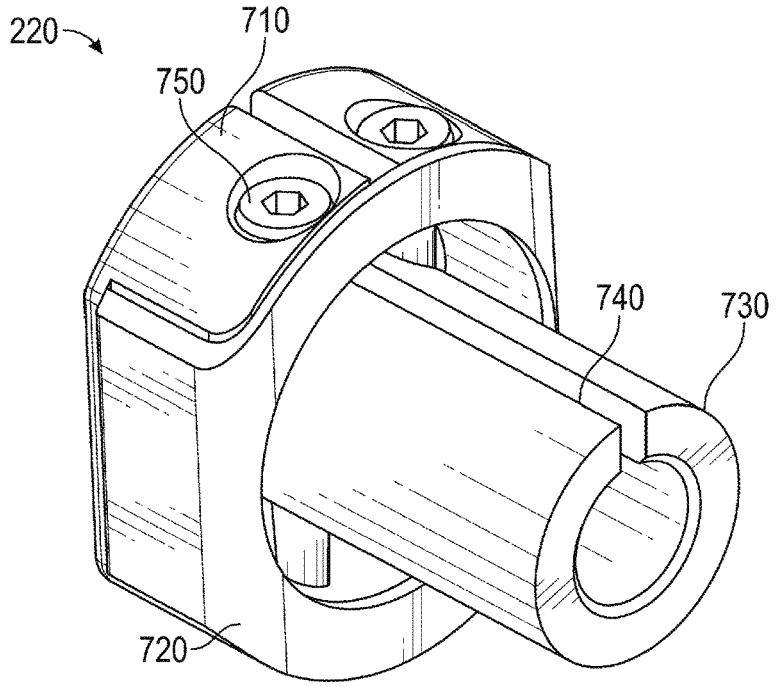
FIG. 7 is a 3-D view of a preload retainer for use with the mating plug for one embodiment according to the present disclosure.

FIG. 7 shows a diagram of an embodiment of the preload retainer 220. The preload retainer 220 may include a boss 710 with an outer diameter larger than the inner diameter of the boss 420 so that the preload retainer 220 cannot pass into the mating plug 240. A saddle 720 is disposed on the boss 710 to provide a cushion between the boss 420 and the boss 710. The saddle 720 may be comprised of an elastomeric material, which may be the same or different than the elastomeric material used for the snubber 230. A wire access tube 730 may be disposed in an orifice of the boss 710 and configured to allow passage of wires between the mating plug 240 and the mating plug 250. The wire access tube 730 may include an optional slot 740 to permit access to its interior. The wire access tube 730 has an outer diameter that is less than the inner diameter of the mating plug 240 and is configured for partial insertion into the mating plug 240. The wire access tube 730 is held in position relative to boss 710 by one or more cross pins 750.

Figure 8:
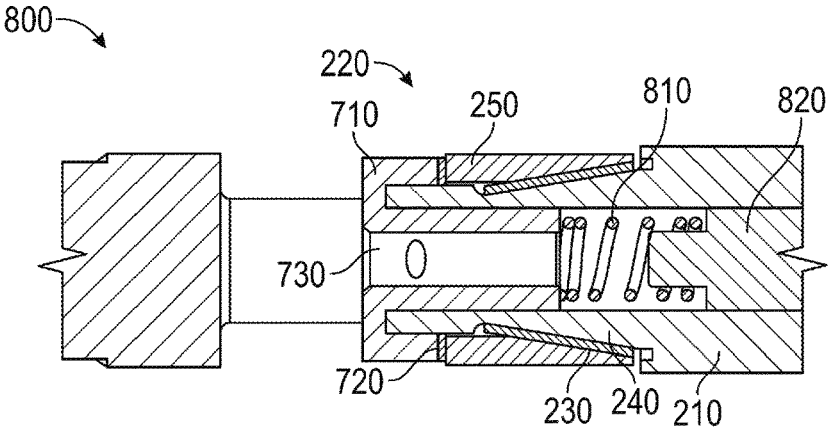
FIG. 8 is a 2-D cross-sectional view along the length of the connection between the mating plug and the mating receptacle with a preload retainer from FIG. 2B.

FIG. 8 shows a diagram of the preload retainer 220 with the wire access tube 730 inserted into the mating plug 240. The downhole component 210 is equipped with a spring 810 and a concentric multi-pin connector 820. The wire access tube 730 is configured to apply force to the spring 810 such that the spring 810 is compressed when the preload retainer 220 is disposed on the mating plug 240.

Figure 9:
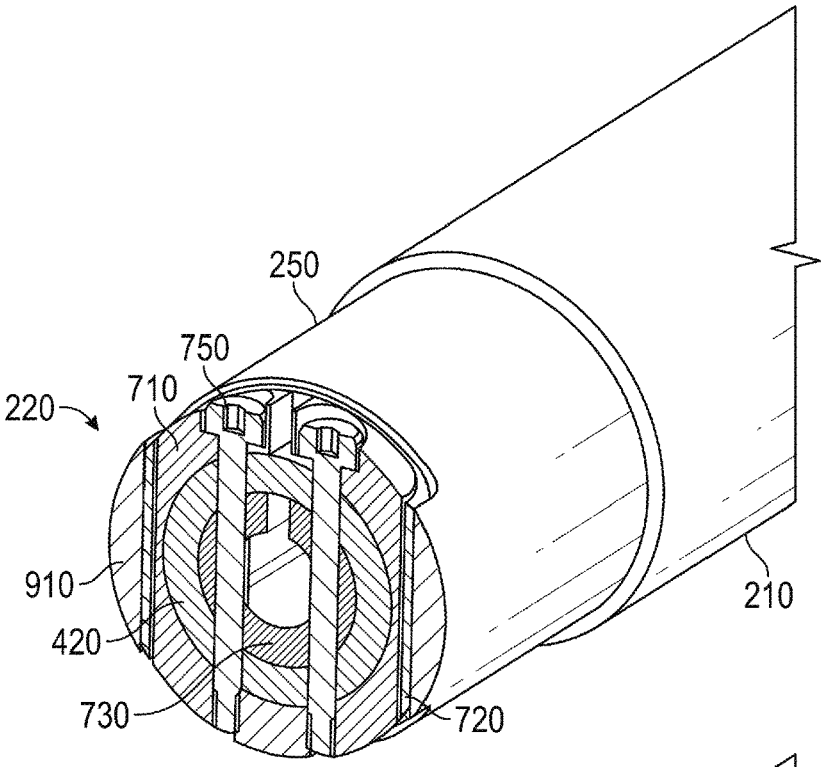
FIG. 9 is a 3-D cross-sectional view perpendicular to the axis of the downhole tool and through the preload retainer according to one embodiment of the present disclosure.

FIG. 9 shows a cross-sectional view of the preload retainer 220 while mounted to the downhole component 210. With the mating receptacle 250 connected to the mating plug 240, the preload retainer 220 is inserted between a pair of raised surfaces 910 of the mating receptacle 250. The raised surfaces 910 prevent rotational movement of the preload retainer 220 when the downhole component 210 and downhole tool 180 are exposed to twisting forces. Here, the intersection of the cross pins 750 and the wire access tube 730 may be seen. The saddle 720 may provide rotational and lateral damping of mechanical shocks.

Figure 10:
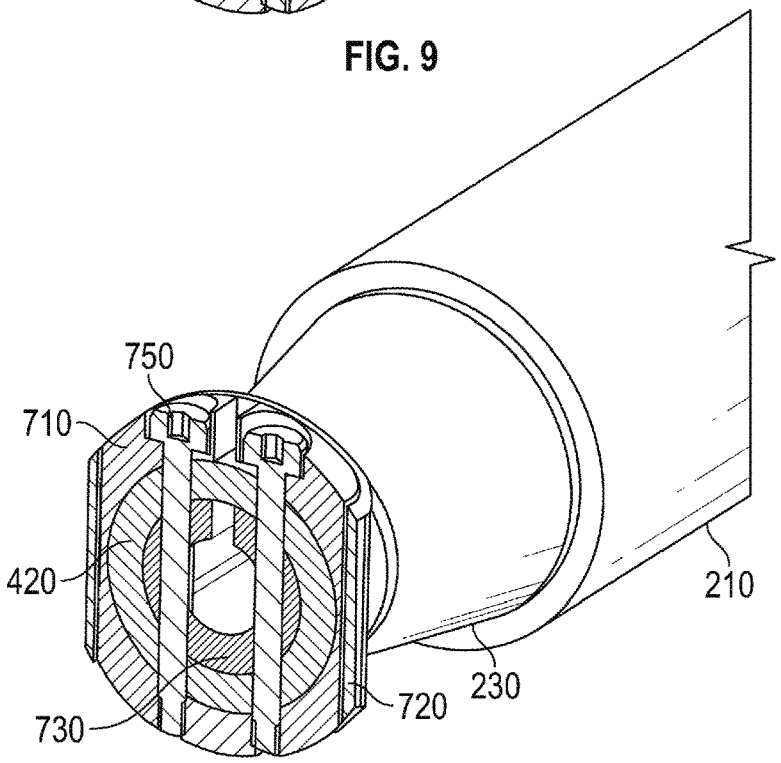
FIG. 10 is a 3-D cross-sectional view perpendicular to the axis of the downhole tool of FIG. 9 with the mating receptacle removed.

FIG. 10 shows the cross-sectional view of FIG. 9 where the mating plug 240 is exposed for viewing. In some embodiments, the preload retainer 220 may be formed as part of the mating plug 240 rather than inserted and secured by cross pins 250. Since the mating receptacle 250 cannot be mated to the mating plug 240 though sliding engagement while the preload retainer 220 in place, the mating receptacle 250 may be formed of two or more pieces that may be reformed around the mating plug 240 in order to form the connection. The frustum-shape of the snubber 230 provides rotational and lateral shock dampening, which augments the dampening provided by the saddle 720. In fact, the entire surface of the snubber 230 contributes to the damping action in addition of the saddle 720 for dampening rotational shocks.

Figure 11:
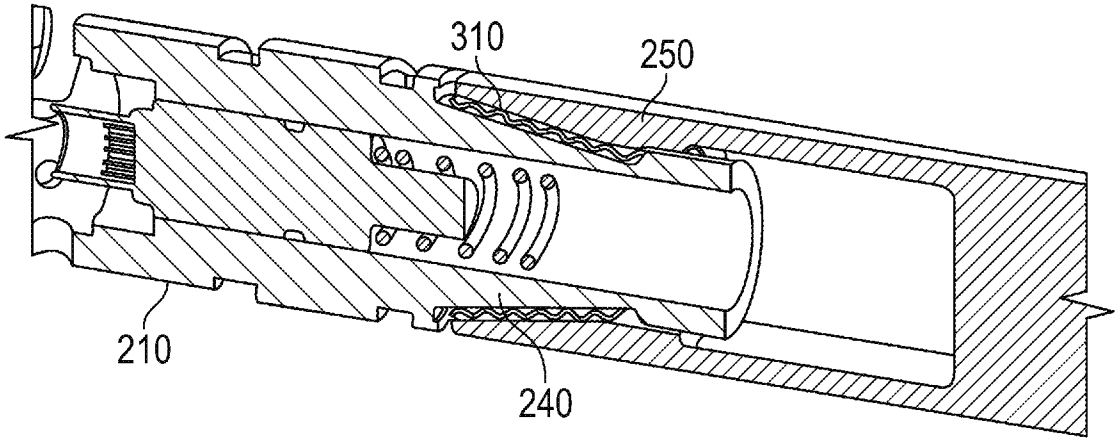
FIG. 11 is a 3-D cross-sectional view along the length of a metal snubber disposed between the mating plug and the mating receptacle according to one embodiment of the present disclosure.

FIG. 11 shows an embodiment where a metal snubber 310 disposed between the mating plug 240 and the mating receptacle 250. The metal snubber 310 is radially corrugated, and the outer surface of the mating plug 240 and the inner surface of the mating receptacle 250 are substantially smooth.

Figure 12A:
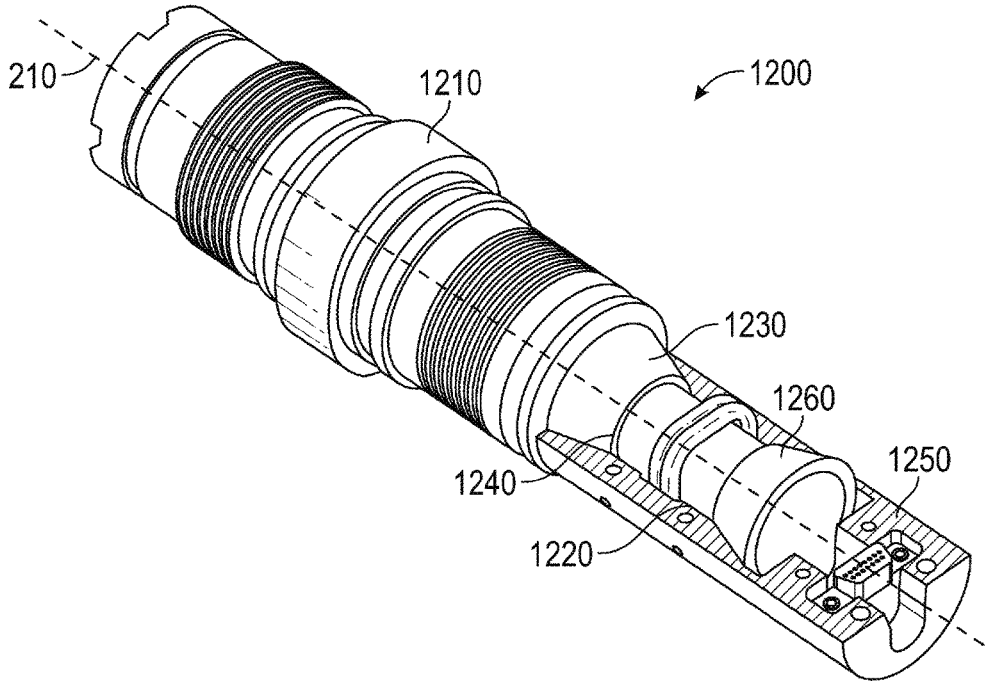
FIG. 12A is a 3-D view of a interconnection for a downhole tool with opposing snubbers and with the a cover plate of the chassis removed according to one embodiment of the present disclosure.
Figure 12B:
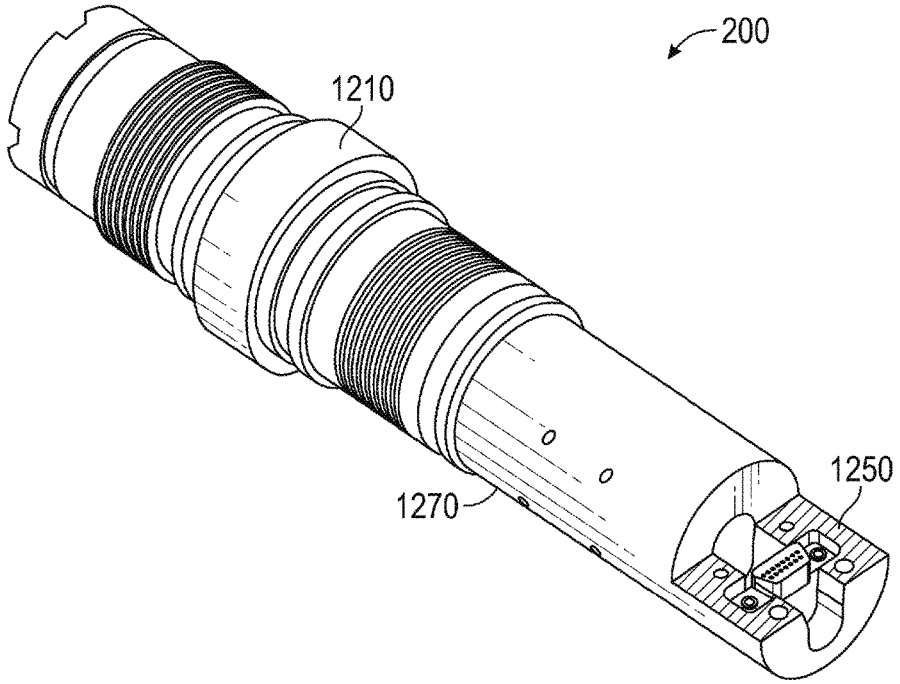
FIG. 12B is a 3-D view of the interconnection of FIG. 12A with the chassis of the downhole tool closed.

FIGS. 12A and 12B show an interconnection 1200 between a downhole component 1210 and a downhole tool chassis 1250. The downhole component 1210 is shown with a mating plug 1240 configured to be received by a cavity 1220 in the downhole tool chassis 1250. The snubbers 1230, 1260 are disposed on the mating plug 1240, which includes two frustum-shaped sections (not shown) configured to receive the snubbers 1230, 1260. The cavity 1220 may be dimensioned so that the mating plug 1240 may be received into the chassis 1250 in a lateral direction, when a cover 1270 is removed, but may not be received or disengage through movement in an axial direction. The snubbers 1230,

1260 have the shape of frustum-shaped sleeves, such as the snubbers 230, 310, 320, 330. The snubber 1230 may be the same or different in dimension relative to the snubber 1260. The snubbers 1230, 1260 substantially conform to the shape of the mating plug 1240 and are arranged so that the smaller diameter openings of the hollow frusta are adjacent. While the downhole component 1210 is shown with the mating plug 1240 and the downhole tool chassis 1250 with the cavity 1220, this is illustrative and exemplary only. In some embodiments, the downhole tool chassis 1250 may have the mating plug 1240 and the downhole component 1210 may have the cavity 1220.

Figure 13:
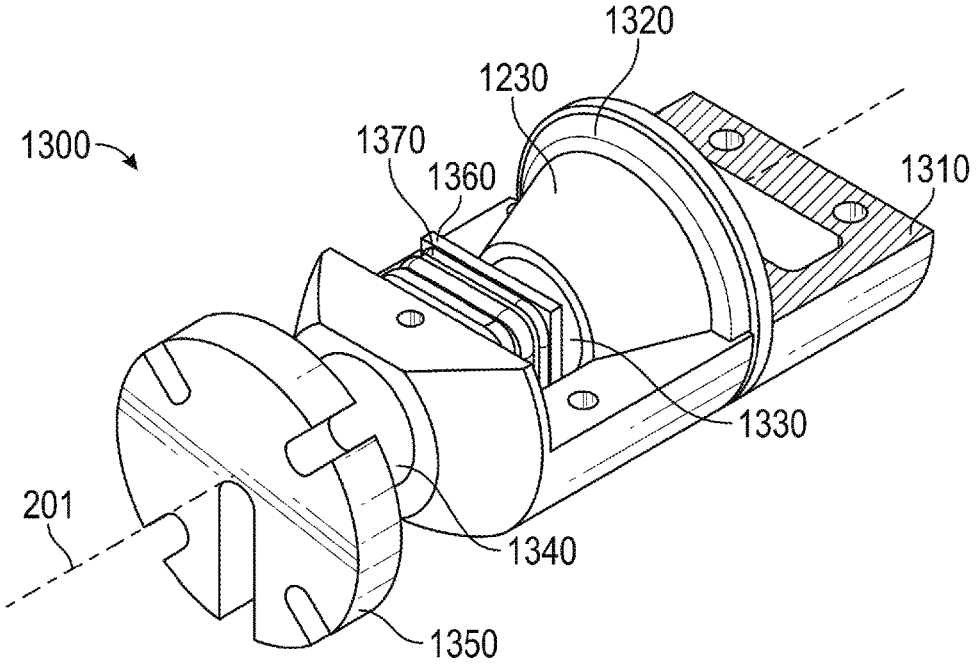
FIG. 13 is a 3-D view of snubber assembly configured for a downhole tool according to one embodiment of the present disclosure.

FIG. 13 shows a snubber assembly 1300 for use with a downhole tool 210. A cover plate 1310 configured to be received by the downhole tool 210. The cover plate 1310 includes a frustum-shaped base (not shown) configured to receive the snubber 1230. The snubber 1230 is secured from axial movement by raised portions 1320, 1330 of the base that are one either side of the snubber 1230 in the axial direction 201. The assembly 1300 includes a mounting foot 1350 configured for attachment to another downhole component and a shaft 1340 through which shock and vibration may be transmitted the snubber 1230 for absorption. The assembly 1300 also includes an optional snubber layer 1360, which may augment the axial shock protection provided by the snubber 1230. The optional snubber layer 1360 may be supported by an optional support plate 1370 disposed as with its plane perpendicular to the axial direction 201. In some embodiment, there may be multiple alternating optional snubber layers 1360 and optional support plates 1370.

While embodiments in the present disclosure have been described in some detail, according to the preferred embodiments illustrated above, it is not meant to be limiting to modifications such as would be obvious to those skilled in the art.

The foregoing disclosure and description of the disclosure are illustrative and explanatory thereof, and various changes in the details of the illustrated apparatus and system, and the construction and the method of operation may be made without departing from the spirit of the disclosure.

What is claimed is:

1. An apparatus for operating in a borehole, the apparatus comprising:

a downhole tool configured to perform an electronic operation;

a downhole component configured to interconnect with the downhole tool; and a frustum-shaped sleeve disposed between the downhole tool and the downhole component at the interconnection and comprising a mechanical shock absorbing material;

wherein one of the downhole tool and the downhole component has a frustum-shaped mating plug and the other one of the downhole tool and the downhole component has a mating receptacle configured to receive the frustum-shaped mating plug, wherein the receptacle includes a first opening and a second opening; and wherein the frustum-shaped mating plug is hollow and includes an outer surface configured to receive the frustum-shaped sleeve;

a preload retainer configured to be partially inserted into a smaller of the first opening and the second opening of the mating receptacle, wherein the preload retainer comprises:

a boss dimensioned to be larger than an inner diameter of the smaller of the first opening and the second opening, and a tube with an outer diameter that is smaller than the inner diameter of the smaller of the first opening and the second opening.

2. The apparatus of claim 1, wherein the frustum-shaped sleeve comprises:

a central axis;

a radially inner surface;

a radially outer surface; and a mechanical shock absorbing material;

wherein the radially inner surface or the radially outer surface of the frustum-shaped sleeve comprises a pyramidal frustum-shaped surface with four or more circumferentially adjacent sides;

wherein the downhole tool or the downhole component has a pyramidal frustum-shaped surface configured to mate with the pyramidal frustum-shaped surface of the frustum-shaped sleeve.

3. The apparatus of claim 2, wherein the outer surface of the frustum-shaped mating plug comprises the pyramidal frustum-shaped surface configured to receive the frustum-shaped sleeve and mate with the pyramidal frustum-shaped surface of the frustum-shaped sleeve.

4. The apparatus of claim 3, wherein the mechanical shock absorbing material comprises a metal.

5. The apparatus of claim 4, wherein frustum-shaped mating plug is made of the same metal as the frustum-shaped sleeve.

6. The apparatus of claim 4, wherein the mechanical shock absorbing material is selected to retain its temper in a temperature range of −50 degrees C. to 175 degrees C.

7. The apparatus of claim 2, wherein the downhole component comprises one of: another downhole tool and a centralizer.

8. The apparatus of claim 2, wherein the frustum-shaped sleeve includes a first end and a second end axially opposite the first end;

wherein each of the plurality of sides of the pyramidal frustum-shaped surface of the frustum-shaped sleeve extends linearly from the first end to the second end.

9. The apparatus of claim 2, wherein the radially inner surface of the frustum-shaped sleeve comprises the pyramidal frustum-shaped surface of the frustum-shaped sleeve and the radially outer surface of the frustum-shaped sleeve is a conical frustum-shaped surface; or wherein the radially outer surface of the frustum-shaped sleeve comprises the pyramidal frustum-shaped surface of the frustum-shaped sleeve and the radially inner surface of the frustum-shaped sleeve is a conical frustum-shaped surface.

10. The apparatus of claim 2, the frustum-shaped sleeve having an interior angle in a range of 5 degrees to 80 degrees.

11. The apparatus of claim 10, the frustum-shaped sleeve having an interior angle in a range of 5 degrees to 35 degrees.

12. The apparatus of claim 11, the frustum-shaped sleeve having an interior angle in a range of 8 degrees to 28 degrees.

13. The apparatus of claim 2, wherein the mating receptacle has an inner surface comprising the pyramidal frustum-shaped surface configured to receive the frustum-shaped sleeve and mate with the pyramidal frustum-shaped surface of the frustum-shaped sleeve.

14. The apparatus of claim 2, wherein the radially inner surface of the frustum-shaped sleeve comprises the pyramidal frustum-shaped surface and the radially outer surface of the frustum-shaped sleeve comprises a pyramidal frustum-shaped surface with four or more circumferentially adjacent sides;

wherein the downhole tool or the downhole component has a pyramidal frustum-shaped surface configured to mate with the pyramidal frustum-shaped surface of the radially inner surface of the frustum-shaped sleeve; and wherein the other of the downhole tool or the downhole component has a pyramidal frustum-shaped surface configured to mate with the pyramidal frustum-shaped surface of the radially outer surface of the frustum-shaped sleeve.

15. The apparatus of claim 1, wherein the frustum-shaped mating plug includes an outer surface that further includes a plurality of separate axially spaced ridges and a plurality of axially spaced grooves interspaced between the plurality of ridges; and wherein each of the ridges and each of the grooves extend circumferentially about a central axis of the frustum-shaped mating plug.

16. The apparatus of claim 1, wherein the frustum-shaped mating plug includes an outer surface that is smooth.

17. The apparatus of claim 1, wherein the downhole component comprises one of: another downhole tool and a centralizer.

18. The apparatus of claim 1, wherein the mechanical shock absorbing material comprises an elastomeric material.

19. The apparatus of claim 18, wherein the elastomeric material has a durometer value between 10A and 60A.

20. The apparatus of claim 19, wherein the elastomeric material has a durometer value of between 20A and 40A.

21. The apparatus of claim 19, wherein the elastomeric material has a deformation point above 260 degrees C.

22. The apparatus of claim 19, wherein the elastomeric material retains is durometer value over a temperature range of −50 degrees C. to 175 degrees C.

23. The apparatus of claim 18, wherein the elastomeric material is silicone.

24. The apparatus of claim 1, wherein the mechanical shock absorbing material of the frustum-shaped sleeve comprises a corrugated metal;

wherein the frustum-shaped sleeve has an axis; and wherein the corrugated metal is one of:

corrugated radially relative to the axis; and corrugated longitudinally relative to the axis.

25. The apparatus of claim 24, wherein the mechanical shock absorbing material is selected to retain its temper in a temperature range of −50 degrees C. to 175 degrees C.

26. The apparatus of claim 1, wherein the frustum-shaped mating plug and the mating receptacle are configured to slidingly engage to form the interconnection.

* * * * *